United States Patent [19]

Takahashi

[11] Patent Number: 4,621,920

[45] Date of Patent: Nov. 11, 1986

[54] PRECONDITIONING A PHOTOSENSITIVE DRUM PRIOR TO ACTUAL PHOTOCOPYING

[75] Inventor: Yoshiaki Takahashi, Kanagawa, Japan

[73] Assignee: Fuji Photo Film Co., Ltd., Japan

[21] Appl. No.: 404,744

[22] Filed: Aug. 3, 1982

[30] Foreign Application Priority Data

Aug. 3, 1981 [JP] Japan ..... 56-122324

[51] Int. Cl.[4] ..... G03G 15/00

[52] U.S. Cl. ..... 355/3 R; 355/3 CH

[58] Field of Search ..... 355/3 R, 11, 14 R, 3 DR, 355/3 CH, 14 CH; 250/324; 430/125, 126, 55, 94

[56] References Cited

U.S. PATENT DOCUMENTS

| | | | |
|---|---|---|---|
| 2,965,756 | 12/1960 | Vyverberg | 250/324 |
| 3,834,807 | 9/1974 | Fuller et al. | 355/3 R |
| 4,119,373 | 10/1978 | Frishman et al. | 430/126 X |
| 4,142,889 | 3/1979 | Tanaka et al. | 430/94 |
| 4,175,955 | 11/1979 | Seino et al. | 430/94 X |
| 4,366,220 | 12/1982 | Saito | 430/94 X |
| 4,413,897 | 11/1983 | Kohyama | 355/3 CH |

OTHER PUBLICATIONS

Excerpt from Schaffert's "Electrophotography," pp. 67–68.

*Primary Examiner*—Fred L. Braun

*Attorney, Agent, or Firm*—Sughrue, Mion, Zinn, Macpeak and Seas

[57] ABSTRACT

A method of electronically photocopying a document in which the copies produced by a series of copying cycles are of uniform contrast. At the start of a photocopying sequence and before any image recording, the photosensitive drum is erased by a lamp and then charged with a charge corotron. This rotating charge is then depleted by a "prefatigue" source of both infrared rays and visible light. The prefatigue source lowers the initial charge density to the level of the subsequent charge densities produced by the normal charge fatigue of the photosensitive material. This "preconditioning" cycle is completed through one revolution of the recording drum, prior to the initiation of normal copying cycles and prior to any imaging upon the drum. Thereafter a series of one or more normal photocopying cycles are performed with perhaps multiple recordings of images on the already preconditioned drum. Thus, the charge densities are uniform throughout the series of copying cycles after the preconditioning and the copies produced thereby are of uniform contrast.

4 Claims, 5 Drawing Figures

PRECONDITIONING A PHOTOSENSITIVE DRUM PRIOR TO ACTUAL PHOTOCOPYING

BACKGROUND OF THE INVENTION

This invention relates to an electronic photographing method in which an electronic photographic photosensitive plate is subjected to the steps of charging, exposing, developing, transferring and cleaning, to continuously obtain a number of copies.

If an electronic photographing photosensitive plate employed in an electronic photographing method of this type is continuously and repeatedly used, it becomes fatigued and its charging potential becomes relatively low. However, if the plate is not used for a long time between photocopying cycles, its charging potential during the first of the photocopying cycles will be greater than the potential for the rest of the photocopying cycles.

FIG. 1 shows an example of this variation in initial charging potential for such an electronic photographing photosensitive plate. In FIG. 1, the horizontal axis indicates the frequency of use of an electronic photographing photosensitive plate, i.e., the number of continuous copying operations completed on the plate. The vertical axis indicates the charging potential of the plate. In FIG. 1, curve A shows the variation in charging potential for the case when a continuous copying operation is started after a relatively long inactive period. The curve B of FIG. 1 shows the variation in charging potential for the case when the continuous copying operation is started after a relatively short inactive period. As is apparent from these curves, when continuous copying is carried out after the use of the electronic photographing photosensitive plate has been stopped or delayed for any period of time, the first copy is different in density (i.e., it is darker) than those copies printed immediately following. This phenomenon is also caused by the rise in charging potential of the electronic photographing photosensitive plate due to a reduction in the intensity of the erase lamp of the photocopying machine.

SUMMARY OF THE INVENTION

An object of the present invention is thus to provide an electronic photographing method in which the abovedescribed drawback accompanying the conventional method are eliminated.

Another object of this invention is to provide an electronic photographing method where the resultant copies are constant in density at all times.

The foregoing objects have been achieved by the use of an electronic photocopying method in which copying operations are continuously effected through the steps of charging, exposing, developing, transferring and cleaning an electronic photographic photosensitive plate, in which, before a copying operation is started, the photosensitive plate is charged and infrared rays including visible rays are applied to its surface, to reduce the initial charge density to the approximate level of the subsequent charge densities. This "preconditioning cycle" is completed during one revolution of the photosensitive drum, with normal copying cycles being initiated thereafter.

DESCRIPTION OF THE PREFERRED EMBODIMENTS

Figure 2:
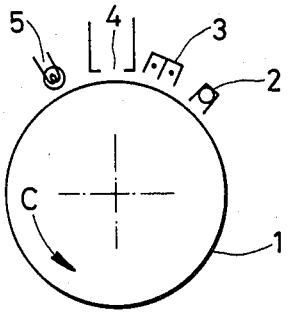
FIG. 2 is a schematic diagram of the arrangement of a photosensitive drum and its relevant components for practicing the electronic photocopying method of the present invention.
Figure 4:
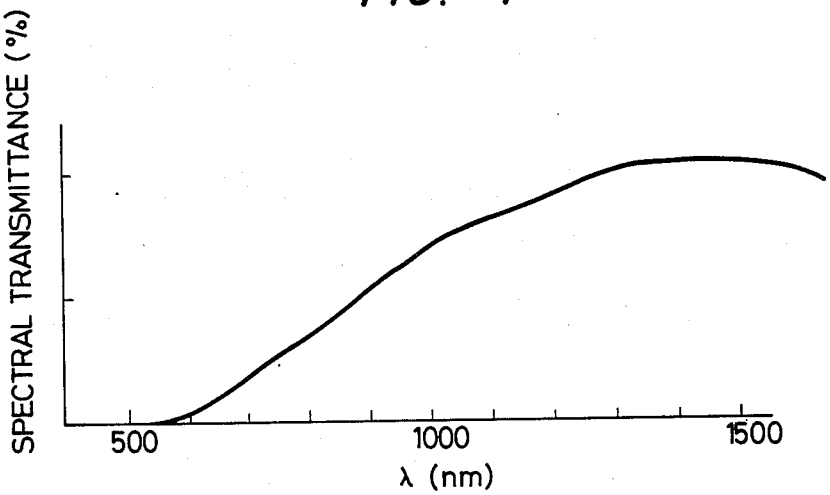
FIG. 4 is a graph indicating the spectral characteristic of the prefatigue lamp employed in the present invention.

FIG. 2 illustrates the general arrangement of the relevant components of a copying machine for practicing an electronic photographing method according to the invention. The photosensitive plate drum 1 is turned in the direction of the arrow, and erase lamp 2, charge corotron 3, copying exposure system 4 and prefatigue lamp 5 are arranged in the direction of rotation of the drum 1 in the stated order. The prefatigue lamp 5 is used to irradiate the surface of the drum 1 to "prefatigue" the photosensitive plate, lowering its charging characteristic such that its charge density at the start of the first photocopying cycle will be the same as its charge densities in the subsequent photocopying cycles. The spectral characteristic of the lamp 5 is preferably such that the lamp 5 can emit infrared rays including visible rays, as shown in FIG. 4.

Figure 3:
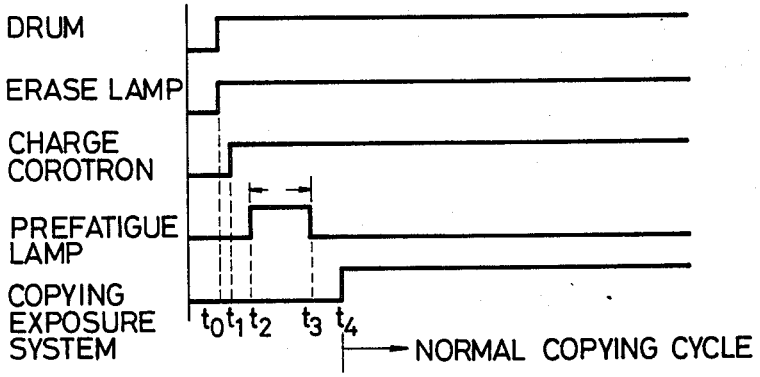
FIG. 3 is a timing chart showing the sequence of operations of the electronic photocopying method of the present invention.

FIG. 3 is a timing chart indicating the sequence of operations of the essential components when the device shown in FIG. 2 carries out its copying operation. First, the copying machine is operated to start the copying operation. At time $t_0$, the drum 1 turns, and the erase lamp 2 is turned on. At time $t_1$, when a portion of the drum which has been irradiated by the erase lamp 2 is immediately below the charge corotron 3, the charge corotron is energized to charge the drum 1. At time $t_2$, when a portion of the drum which has been charged by the charge corotron 3 is immediately below the prefatigue lamp 5, the prefatigue lamp 5 is energized to apply infrared rays (including visible rays) to the surface of the photosensitive plate drum 1. The irradiation by the prefatigue lamp 5 is continued until the time $t_3$ (when the drum 1 has completed one revolution). During this period, the copying exposure system 4 is not operated, and no copying operation is carried out.

Once the drum has completed one revolution in the above described manner, the copying exposure system 4 is initiated and copying cycles are carried out thereafter in the usual manner. That is, when a copying instruction is first issued, the erase lamp 2 is energized, the charge corotron 3 carries out the charging operation, and the prefatigue lamp 5 applies infrared rays including visible rays, in the stated order during one revolution of the drum, with the ordinary copying cycle beginning thereafter. The ordinary copying cycle after the preconditioning cycle comprises at least four steps: (1) charging the photosensitive drum with the charge corotron 3, (2) developing an image on the photosensitive drum formed with the copying exposure system 4, (3) transferring the developed image to another recording medium, and (4) erasing the drum 1 by energizing the erase lamp 2. All these steps are well known in the art of electrostatic copying.

Figure 1:
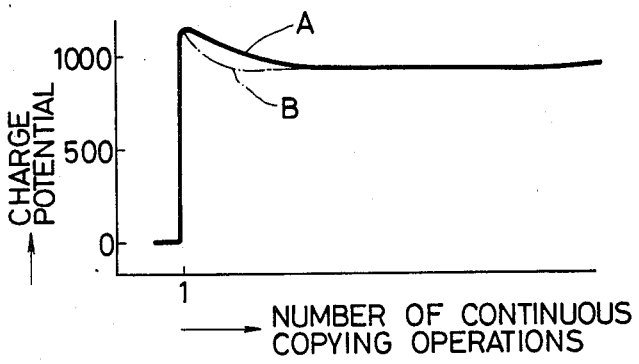
PRIOR ART FIG. 1
FIG. 1 is a graph indicating the variations in charging potential of a photosensitive material after a copying operation has been started in accordance to a conventional method.
Figure 5:
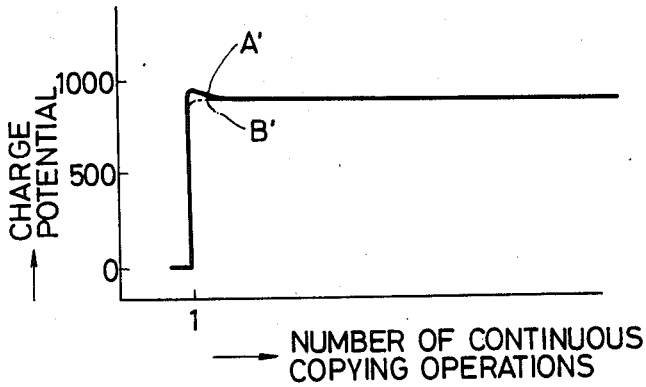
FIG. 5 is a graph indicating the variations in charging potential of a photosensitive material after a copying operation has been started in accordance to the method of the present invention.

FIG. 5 shows the relation between the charge potential and the number of times of continuous copying operations with the drum "preconditioned" in the manner as described above. In FIG. 5, the curve A′ shows the variation in potential when a copying operation is started after a relatively long inactive or stop period. As is apparent upon a comparison of curve A′ in FIG. 5 with curve A in FIG. 1, the difference between initial charging potential and the subsequent charging potentials is suppressed by the "preconditioning cycle" described above. Further, in FIG. 5, the curve B′ shows the variation in charging potential when the copying operation is started after a relatively short inactive period. As is clear upon a comparison of the curve B′ in FIG. 5 with the curve B of FIG. 1, the rise of the initial charging potential is suppressed due to the preconditioning cycle.

As is apparent from the curves in FIG. 5, according to the method of the invention, the rise of the initial potential of the photosensitive material is suppressed, and therefore copies constant in density can be obtained throughout a sequence of copying cycles.

What is claimed is:

1. A preconditiong method for a rotating photosensitive recording drum of a photocopying machine, comprising the consecutive steps of:

erasing uniformly a full copying portion of said photosensitive drum by energizing an erase lamp;

charging uniformly a full copying portion of said photosensitive drum, and energizing a prefatigue lamp to expose uniformly a full copying portion of said photosensitive drum to infrared and visible rays, all said steps being performed prior to recording of an image on said photosensitive drum and erasing and charging said drum for said recording.

2. A method for electronically photocopying a document using a rotating photosensitive drum, comprising:

a first cycle prior to the recording of an image on said photosensitive drum, further comprising:

(a) erasing said photosensitive drum by energizing an erase lamp, (b) then charging said drum, and (c) then energizing a prefatigue lamp for uniformly exposing said photosensitive drum to a plurality of light waves; and at least two subsequent cycles, each comprising;

(d) charging said drum, (e) exposing and developing an image upon said photosensitive drum, (f) transferring said developed image to another recording medium, and (g) erasing said drum by energizing said erase lamp; and wherein said prefatigue lamp is not activated in said subsequent cycles.

3. The method of electronically photocopying a document as recited in claim 2, wherein said prefatigue lamp exposes said drum to both infrared light and visible light.

4. The method of electronically photocopying a document as recited in claim 2, wherein steps (a) through (c) are completed through one revolution of said photosensitive drum.

* * * * *

UNITED STATES PATENT AND TRADEMARK OFFICE

CERTIFICATE OF CORRECTION

PATENT NO. : 4,621,920

DATED : November 11, 1986

INVENTOR(S) : Yoshiaki Takahashi

It is certified that error appears in the above-identified patent and that said Letters Patent is hereby corrected as shown below:

Title page:

(73) Assignee: Fuji Xerox Co., Ltd.,
Tokyo, Japan

Signed and Sealed this

Twenty-seventh Day of January, 1987

*Attest:*

DONALD J. QUIGG

*Attesting Officer* *Commissioner of Patents and Trademarks*